United States Patent [19]

Stabile

[11] 4,163,519

[45] Aug. 7, 1979

[54] COMPENSATING ROTOR

[75] Inventor: James Stabile, Scarsdale, N.Y.

[73] Assignee: Union Carbide Corporation, New York, N.Y.

[21] Appl. No.: 847,615

[22] Filed: Nov. 1, 1977

[51] Int. Cl.[2] ..... B04B 9/08

[52] U.S. Cl. ..... 233/26; 74/410

[58] Field of Search ..... 233/23 R, 24, 25, 26, 233/23 A, 1 C; 74/797, 410, 801; 210/31 C, 198 C

[56] References Cited

U.S. PATENT DOCUMENTS

| | | | |
|---|---|---|---|
| 3,216,270 | 11/1965 | Nasvytis | 74/410 |
| 3,775,309 | 11/1973 | Ito et al. | 233/23 A |
| 3,986,442 | 10/1976 | Khoja et al. | 233/23 R |
| 4,058,460 | 11/1977 | Ito | 210/31 C |

FOREIGN PATENT DOCUMENTS

| | | | |
|---|---|---|---|
| 2611307 | 9/1977 | Fed. Rep. of Germany | 233/23 R |

*Primary Examiner*—George H. Krizmanich

*Attorney, Agent, or Firm*—Frederick J. McCarthy, Jr.

[57] ABSTRACT

A 2:1 compensating rotor is used in a continuous-flow centrifuge system, thereby allowing the dynamic loading and unloading of biological suspensions and processing solutions in a "closed" fashion without resort to rotary seals. Improved high speed performance is obtained by utilization of an inherently symmetrical load sharing epicyclic reverted gear train. The effective lifetime of the component gears is increased due to the load sharing feature of the symmetrical epicyclic reverted gear train.

13 Claims, 6 Drawing Figures

COMPENSATING ROTOR

BACKGROUND OF THE INVENTION

This invention relates to compensating rotors used in continuous-flow centrifuge systems. More specifically, it relates to improvements which facilitate high speed operation of compensating rotors in continuous-flow centrifuge systems.

The application of centrifugal force is widely used in the processing of blood and other biological suspensions. It provides a convenient means for sorting and classifying particulates on the basis of buoyant density differences and for retaining particles subjected to opposing hydrodynamic forces. As Illustrative example of such usage is the continuous-flow washing technique for the deglycerolization of red blood cells.

In flow-through centrifuges, such as those marketed by Fenwal and Haemonetics, centrifugal force is employed to retain the red cell mass in the periphery of a processing container spinning at 3000–4000 rpm while saline solutions of decreasing tonicity are passed continuously through cells at about 150–200 ml/min. in a direction countercurrent to the centrifugal field. In both cases, the fluid exchange is effected in a more or less aseptic fashion by means of a rotary seal.

There are several disadvantages associated with the rotary seal arrangement in blood processing applications. The possibility of contaminants passing between the seal faces exists. Consisting, as it does, of an assembly of precisely machined components of specialty materials, the seal represents a major contribution to the fabrication and quality control costs of the blood processing container, which is designed to be a disposable item. In addition, the seal may impose flow limitations, and high shear rates at the seal juncture may damage the more labile blood components.

A recent advance in centrifugal apparatus development allows continuous-flow blood processing without rotary seals. The "compensating rotor" is a mechanical device which permits the exchange of fluids between a stationary system and a rotating system via an integral tubing loop. The absence of the seal eliminates the contamination risk and permits substantially increased flow rates (> 1 liter/min.) with a corresponding reduction in processing time per unit of cells washed. Such an apparatus is useful not only in deglycerolization, but also in various other modes of centrifugal blood processing, including component separation and pheresis applications.

The effect of the 2:1 relative rotation utilized in the operation of conventional twist compensating devices is well known in the art. Illustrations of the application of this principle are found in U.S. Pat. Nos. 2,831,311 and 3,586,413.

The N.I.H. blood centrifuge of the type described in the article by Y. Ito, et al., "New Flow-Through Centrifuge Without Rotating Seals Applied To Plasmapheresis," *Science* 189, p. 999 (1975) employs 2:1 rotation to effect fluid transfer into a rotating processing container. Similarly, the same principle is utilized in the centrifugal liquid processing system disclosed in U.S. Pat. No. 3,986,442.

It is noted, however, that each of the above prior art devices is somewhat limited in its ability to operate at high rotational speeds. The primary reason for this shortcoming is that each of these devices is inherently unbalanced. As a result, these devices are susceptible to mechanical failure due to the vibration effects experienced at the higher rotational speeds.

It is apparent that the major limitation inherent in each of the prior art devices is its vulnerability at high rotational speeds, due to the 2:1 relative motion between the rotary components, and the associated vibration effects experienced by the mechanical components of the system. Since operating speeds of 3000–4000 rpm are required for effective and economical processing of blood, this is a significant limitation. The need for a continuous-flow centrifuge system capable of operating at 3000–4000 rpm is especially acute in the blood processing industry.

Accordingly, it is an object of the invention to provide a compensating rotor for use in a high-speed continuous-flow centrifuge system. More specifically, it is an object of the invention to overcome the aforementioned difficulties by providing means to inherently balance the compensating rotor in order to minimize the unwanted vibrational effects associated with the operation of conventional twist compensating devices.

It is a further object of the invention to provide a novel inherently symmetrical epicyclic reverted gear train having a minimum number of components which satisfies the requisite 2:1 rotational requirement for a self untwisting mechanism.

It is still a further object of the invention to provide means to share the load between the gears comprising the rotor drive system.

SUMMARY OF THE INVENTION

The foregoing and other objects and advantages which will be apparent in the following detailed description of the preferred embodiment, or in the practice of the invention, are achieved by the invention disclosed herein, which generally may be characterized as a compensating rotor for a high speed continuous-flow centrifuge system, the device comprising:

(a) a fixed base;
(b) a central vertical axis;
(c) an arm assembly rotatably mounted to the fixed base;
(d) a centrifugal processing container;
(e) a platform rotatably mounted to the arm assembly;
(f) means to secure the centrifugal processing container to the platform;
(g) a stationary feed and collection system;
(h) a flexible tubing loop for effecting the exchange of fluid between the centrifugal processing container and the stationary feed and collection system;
(i) a tube guide mounted on the arm assembly enclosing a segment of the tubing loop; and
(j) drive means including an inherently symmetrical load sharing epicyclic reverted gear train for rotating the platform and arm assembly in the same direction about the central vertical axis and at an angular velocity ratio of 2:1 respectively.

DETAILED DESCRIPTION OF PREFERRED EMBODIMENT

Figure 1:
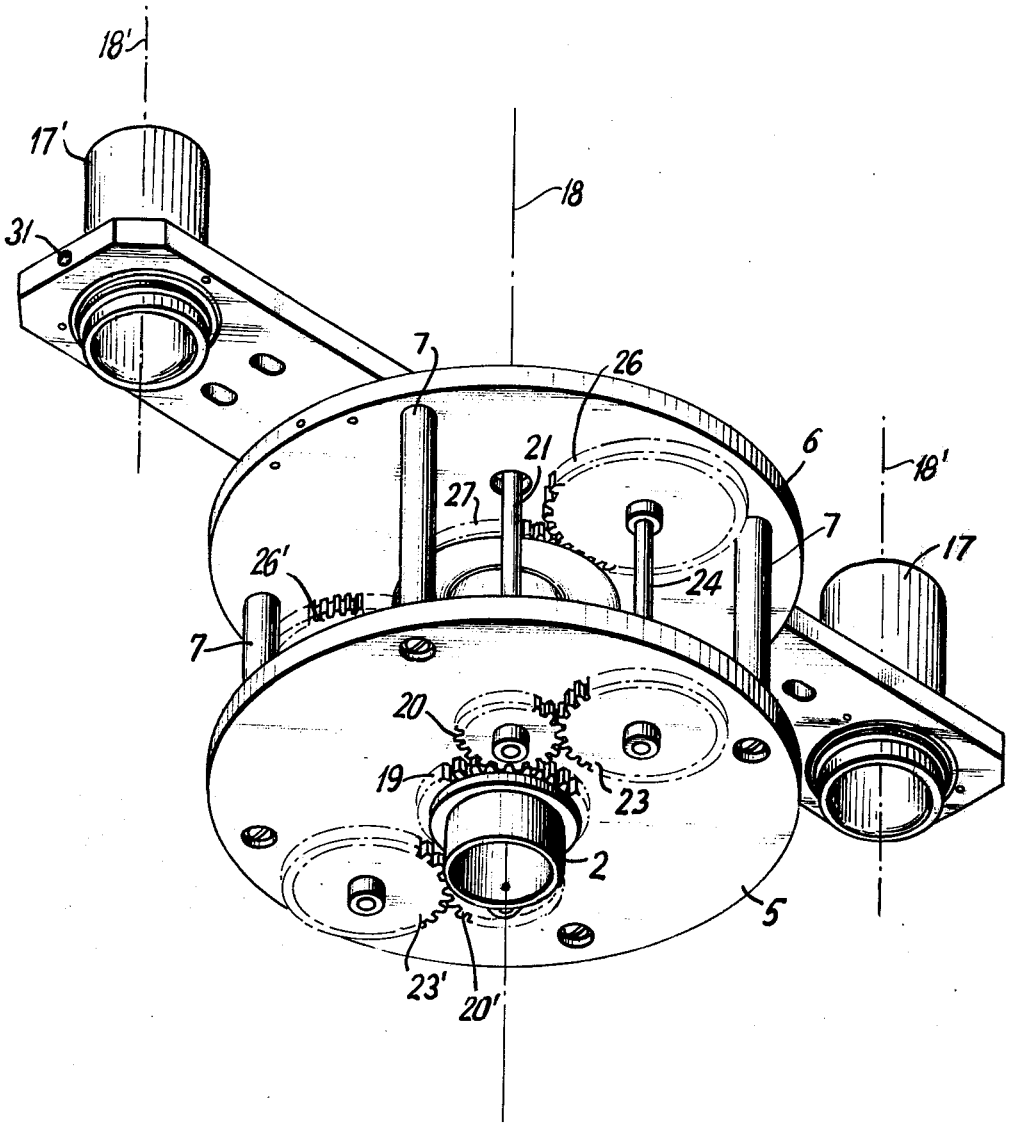
FIG. 1 is a perspective view of a compensating rotor, in accordance with the present invention.

In order to afford a complete understanding of the invention and an appreciation of its advantages, a description of a preferred embodiment is presented below.

Several different views of the compensating rotor are illustrated in FIGS. 1–4. As shown therein, an interface housing 1 is fixed to the centrifuge frame 1' by means of securing screws (not shown). A rotor housing 2 is fixed to the interface housing 1 by means of securing screws 3. An arm assembly consisting of a lower plate 5, an upper plate 6, spacer posts 7, a tube guide mouting arm 8, a drive bearing housing 9 and an outer bearing housing 10 is rotatably connected to a drive shaft 4 linked to a speed controlled motor (not shown). This is done by means of drive bearing housing 9 which is connected to drive shaft 4 by means of securing screws 11.

A fixed gear 19 is secured to the rotor housing 2 by mounting screws (not shown). An intermediate gear 20 is in driving engagement with the fixed gear 19 and is mounted on an intermediate shaft 21. The intermediate shaft 21 is mounted on bearings 22 located in the lower plate 5 and upper plate 6 sections of the arm assembly. A lower transfer gear 23 is in driving engagement with the intermediate gear 20 and is mounted on a transfer shaft 24. The transfer shaft 24 is mounted on bearings 25 located in the lower plate 5 (not shown) and upper plate 6 sections of the arm assembly. An upper transfer gear 26 is mounted to the other end of transfer shaft 24. A rotor drive gear 27 is in driving engagement with the upper transfer gear 26 and is mounted to an inner bearing housing 28. The inner bearing housing 28 is secured to a platform 13 by means of retaining cap 50. As will be shown in more detail below, the gear ratios of the fixed gear 19, intermediate gear 20, lower transfer gear 23, upper transfer gear 26 and rotor drive gear 27 are selected to ensure that a relative 2:1 angular velocity ratio is maintained between the platform 13 and the arm assembly.

The system comprising the fixed gear 19, intermediate gear 20, lower transfer gear 23, upper transfer gear 26, rotor drive gear 27, intermediate shaft 21, transfer shaft 24, and the arm assembly constitutes an epicyclic reverted gear train, perhaps more commonly referred to as a planetary gear train.

Dynamically, the arm assembly is caused to revolve at rotational speed w about a central vertical axis 18 by means of the drive shaft 4 linked to the speed controlled motor (not shown). The motion of the arm assembly is communicated by means of the epicyclic reverted gear train to the platform 13, however, because of the gearing ratios selected, the platform revolves at rotational speed 2 w in the same directional sense as the arm assembly about the central vertical axis 18.

To show that the epicyclic reverted gear train drive elements 19, 20, 23, 26, 27 satisfy the requisite 2:1 angular velocity ratio for a self untwisting mechanism, one must refer to the following basic epicyclic reverted gear train equation found in any standard kinematics textbook:

$$t.v. = \frac{W_F - W_R}{W_A - W_R}$$

where t.v. = static gear train value to be found;

$W_F$ = angular velocity (+2 w) of the rotating platform 13;

$W_R$ = angular velocity (+W) of the rotating arm assembly;

$W_A$ = angular velocity (0) of the fixed gear 19.

Substituting the above values into the epicyclic gear train equation yields:

$$t.v. = \frac{(+2w) - (+w)}{0 - (+w)} = -1.$$

Figure 6:
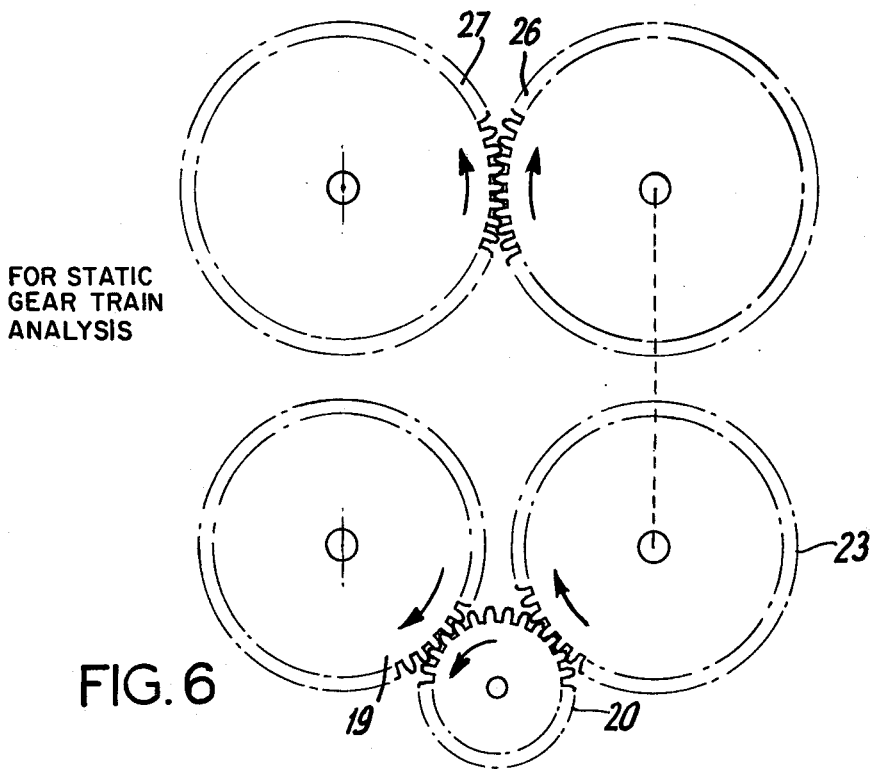
FIG. 6 is a schematic representation for the static gear train analysis of the gears utilized in one-half of a symmetrical load sharing epicyclic reverted gear train, in accordance with the present invention.

It is well known to those skilled in the art that the gear train elements depicted in FIG. 6 resulted in a static train value of −1 when the diameters of fixed gear 19 and lower transfer gear 23 are equal and the diameters of upper transfer gear 26 and rotor drive gear 27 are equal.

Referring now to FIG. 6 it will be confirmed that this configuration does in fact yield a static gear train value of −1. The train value for the lower portion of the epicyclic reverted gear train is given by the following equation:

$$\text{lower } t.v. = \frac{D_{19}}{(-D_{20})} \times \frac{(-D_{20})}{D_{23}}.$$

For the situation where the diameters of fixed gear 19 and lower transfer gear 23 are equal this equation yields:

$$\text{lower } t.v. = \frac{D_{19}}{(-D_{20})} \times \frac{(-D_{20})}{D_{19}} = +1.$$

The train value for the upper portion of the drive train is given by the following equation:

$$\text{upper } t.v. = \frac{D_{26}}{(-D_{27})}.$$

For the situation where the diameters of upper transfer gear 26 and rotor drive gear 27 are equal this equation yields:

$$\text{upper } t.v. = \frac{D_{26}}{(-D_{26})} = -1.$$

The static gear train value for the system is equal to the product of the lower train value and the upper train value. Thus the static gear train value for the system illustrated in FIG. 6 is given by:

$$t.v. = (+1)(-1) = -1.$$

Figure 5:
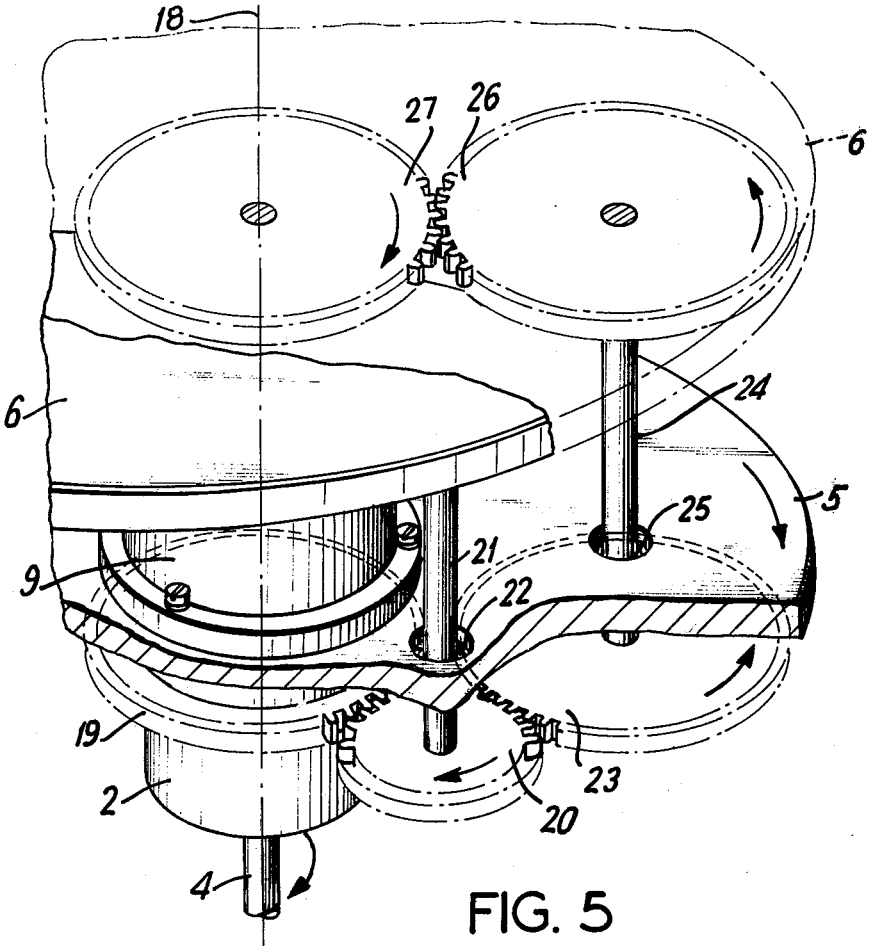
FIG. 5 is a schematic representation of the basic components of one-half of a symmetrical load sharing epicyclic reverted gear train, in accordance with the present invention.

Having established that a static gear train value of −1 results in the requisite 2:1 velocity ratio, it remains to be determined that the epicyclic reverted gear train depicted in FIG. 5 achieves the desired result.

FIG. 5 illustrates, in more detail, the kinematics of the epicyclic reverted gear train. As shown therein, a clockwise rotation of drive shaft 4 causes the lower plate 5 of the arm assembly to rotate in a clockwise direction about the central vertical axis 18. The intermediate gear 20 which is rotatably connected to the arm assembly likewise moves in a clockwise direction about the fixed gear 19 secured to the rotor housing 2. The motion of the intermediate gear 20 about the fixed gear 19 causes the lower transfer gear 23 to move in a counterclockwise direction. This counter-rotary motion is communicated to the upper transfer gear 26 by means of transfer shaft 24. The rotation of upper transfer gear 26 in a counterclockwise direction causes the rotor drive gear 27 to rotate in a clockwise direction. Similarly, platform 13 which is rotatably connected to rotor drive gear 27 rotates in a clockwise direction. Thus a clockwise rotation of drive shaft 4 results in a clockwise rotation of the arm assembly and a clockwise rotation of the platform 13 about the central vertical axis 18. As indicated above, by properly selecting the gear ratios of the fixed gear 19, intermediate gear 20, lower transfer gear 23, upper transfer gear 26, and rotor drive gear 27 to yield a static gear train value of $-1$ the resulting system is one in which the arm assembly rotates at speed w and the platform 13 rotates at speed 2 w in the same directional sense about the central vertical axis 18.

Referring again to FIGS. 1–4, a receptacle housing 12 for holding a centrifugal processing container (not shown) is secured to platform 13 by means of mounting screws 14. The platform 13 contains an opening 15 which permits passage of a flexible fluid-carrying tubing loop 16 connected to the centrifugal processing container. The tubing loop 16, which may contain one or more discrete fluid-carrying tubes, is routed through a tube guide assembly 17 and the centrifuge cover 40 to a stationary feed and collection system (not shown), located above the centrifuge cover. The tubing loop 16 is fixed to the centrifuge cover 40 as it passes through it.

The tube guide assembly 17 is necessary to constrain the tubing loop 16; otherwise, the centrifugal force resulting from the high rotational speeds would cause the tubing loop to break or collapse. The tube guide assembly 17 is secured to the tube guide mounting arm 8 section of the arm assembly and is mounted on bearings 41. The tube guide assembly 17 freely rotates about a tube guide axis 18′ by means of the action of the rotating segment of tubing loop 16 enclosed by the tube guide assembly.

Although the tubing loop 16 does not pass through the second tube guide assembly 17′, in order for the system to be balanced about the central vertical axis 18, it is convenient to provide a second tube guide assembly secured to the tube guide mounting arm 8 section of the arm assembly and mounted on bearings (not shown).

Although the centrifugal processing container (not shown) is rotating at speed 2 w, the tubing loop 16 path is constrained to revolve at speed w relative to the central vertical axis 18 by virtue of its passing through the tube guide assembly 17 which is mounted on the arm assembly rotating at speed w. The rotational axis 18′ of the tube guide assembly 17 is essentially parallel to that of the central vertical axis 18 of the arm assembly and centrifugal processing container. The untwisting or twist-compensating effect of this 2:1 relative motion has the following basis. For every revolution of the centrifugal processing container (not shown), a single twist is imparted to the tubing loop 16. Every revolution of the tube guide assembly 17 imparts two twists in the opposite sense, one each in the tubing loop sections above and below the tube guide assembly. Since the tube guide assembly 17 is fixed to the arm assembly resolving at half the speed of the centrifugal processing container, each half revolution of the tube guide assembly effectively removes the twist imparted by every full revolution of the centrifugal processing container.

So long as the 2:1 angular velocity ratio between the platform 13 and arm assembly is maintained, the compensating rotor is theoretically capable of high speed twist compensating operation. As a practical matter, however, the compensating rotor will never achieve this theoretical speed unless it is balanced about the central axis of rotation 18. This property is achieved by means of an inherently symmetrical load sharing epicyclic reverted gear train, in accordance with the present invention, in conjunction with a mechanical system balanced about the central axis 18.

Figure 2:
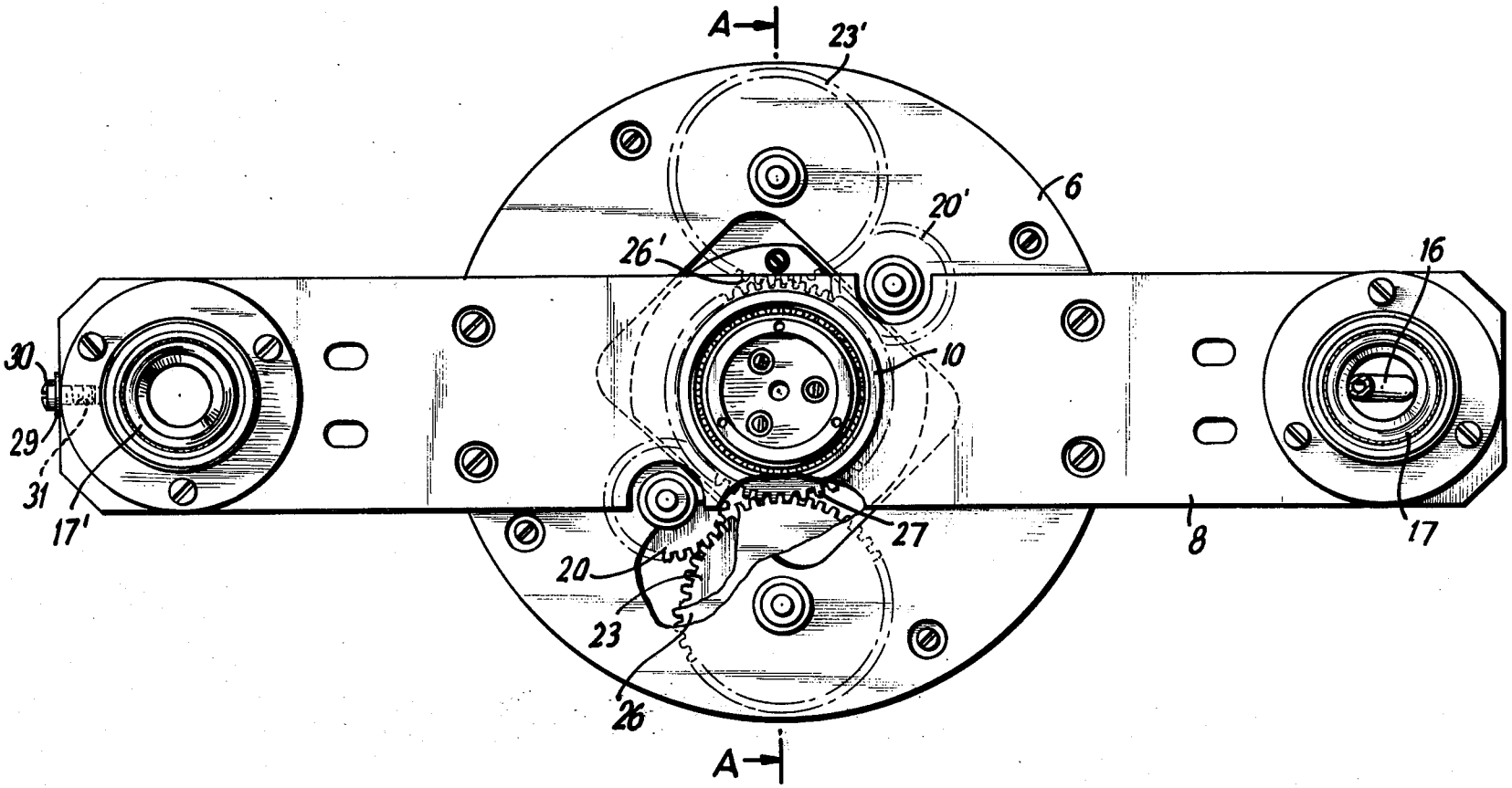
FIG. 2 is a top plan view of the compensating rotor, in accordance with the present invention.
Figure 3:
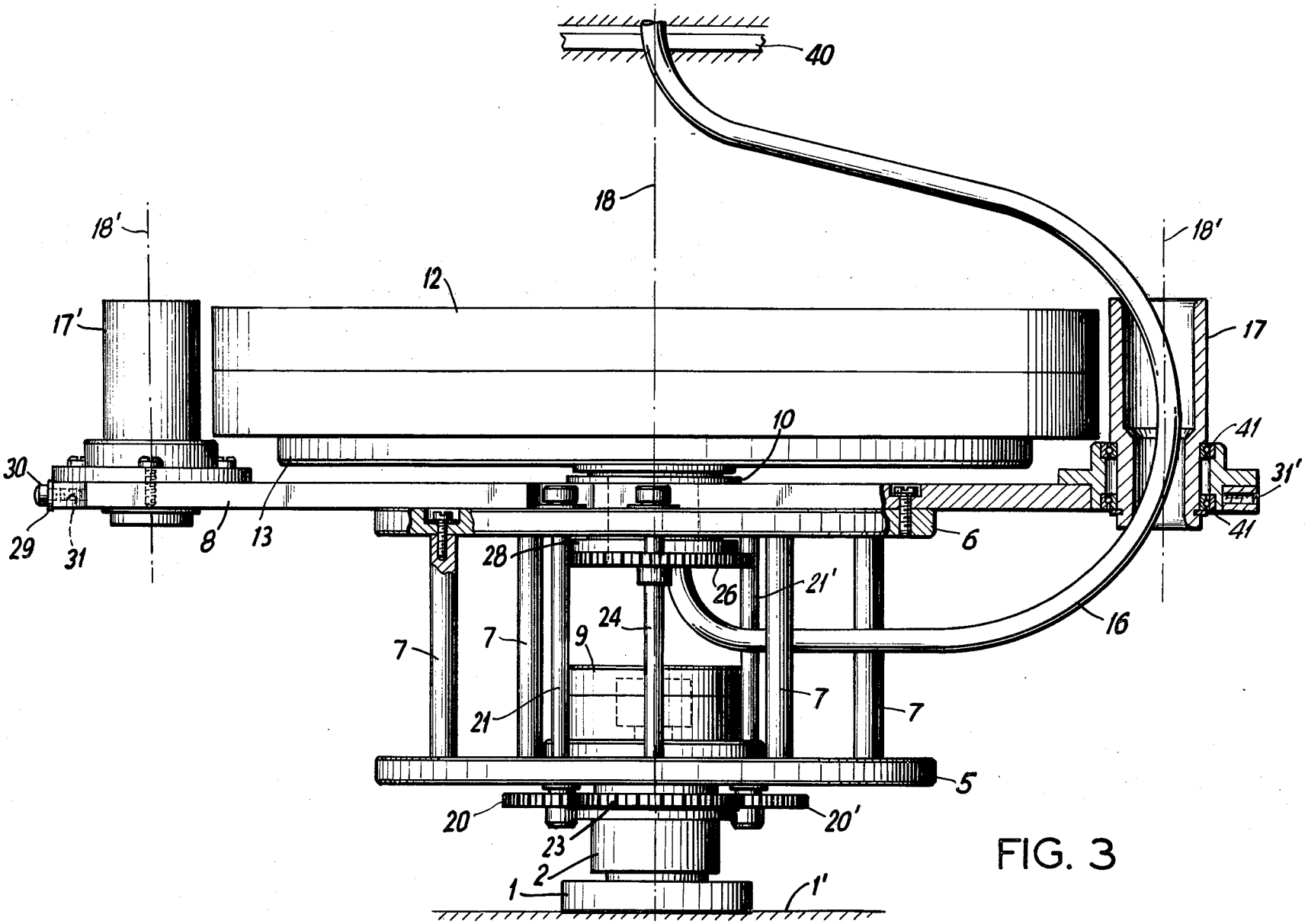
FIG. 3 is an elevation view, partially sectioned showing the tube guide assembly, of a compensating rotor, in accordance with the present invention.
Figure 4:
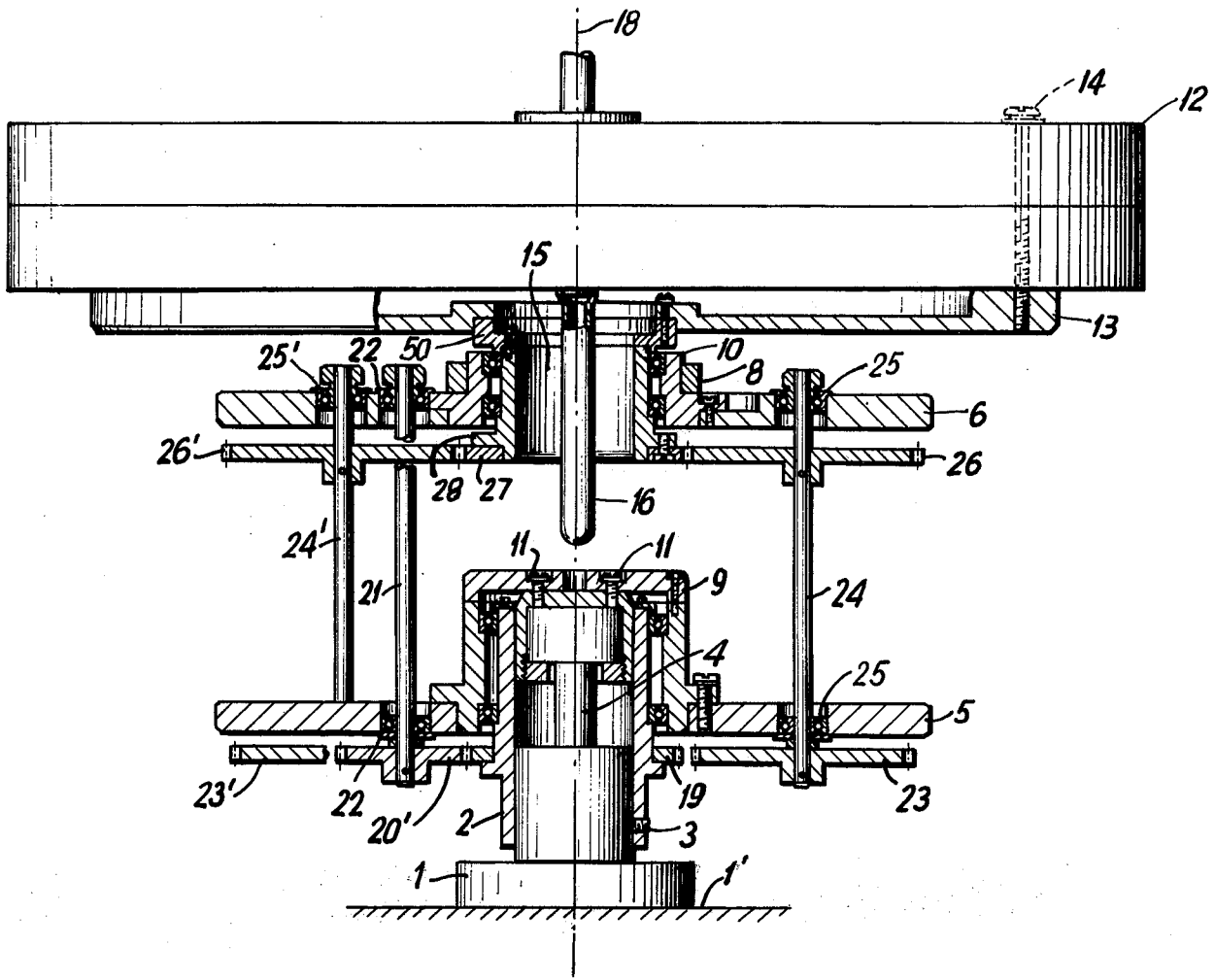
FIG. 4 is a sectional view taken on the line A—A of FIG. 2 with the intermediate gear rotated on the center line.

The preferred embodiment of the inherently symmetrical load sharing epicyclic reverted gear train is best illustrated in FIGS. 2–4. As shown therein, the inherently symmetrical load sharing epicyclic reverted gear train consists of a fixed gear 19, intermediate gear 20, lower transfer gear 23, upper transfer gear 26, rotor drive gear 27, intermediate shaft 21, transfer shaft 24 and the arm assembly, all discussed previously, as well as an additional intermediate gear 20′, lower transfer gear 23′, upper transfer gear 26′, intermediate shaft 21′ and transfer shaft 24′. The added primed components are identical to their unprimed counterparts. Since this system is inherently symmetrical about the central vertical axis 18 the previous discussion concerning the interrelationship between the unprimed components of the epicyclic reverted gear train applies equally as well to the interrelationship between the primed components. As is well known to those skilled in the art, intermediate gear 20′, lower transfer gear 23′ and upper transfer gear 26′ do not affect the 2:1 velocity ratio discussed previously. These gears, 20′, 23′ and 26′, however, equally share the load previously borne by gears 20, 23 and 26. Thus, in addition to providing a novel symmetrical epicyclic reverted gear train resulting in high speed twist compensating operation, the present invention also results in a sharing of the load equally between corresponding component gears, thereby increasing the effective lifetime of the component gears.

In the following discussion only one-half of the inherently symmetrical epicyclic reverted gear train will be considered, however, as is well known to those skilled in the art, whatever is true for the unprimed component parts is necessarily true for the corresponding primed components. Preferably, the diameters of the fixed gear 19 and the lower transfer gear 23 should be equal. The diameter of the intermediate gear should be as small as possible, however, practical considerations dictate that a compromise be reached. It follows that the smaller the diameter of intermediate gear 20 the faster its speed of rotation. Since the life of the intermediate gear 20 and its associated bearings 22 is inversely proportional to the speed of rotation a practical compromise within the geometric constraints of the system must be made with respect to the diameter of intermediate gear 20. The diameters of upper transfer gear 26 and rotor drive gear 27 must be chosen to ensure that the axis of rotation of rotor drive gear 27 is coincident with the central vertical axis 18, thereby minimizing the effects of centrifugal force. Since the diameters of the fixed gear 19 and the lower transfer gear 23 are equal this dictates that the diameters of the upper transfer gear 26 and rotor drive gear 27 also be equal. To further minimize the effects of centrifugal force, it is preferable that all components be located as close as practically possible to the central vertical axis 18.

FIG. 2 illustrates a preferred arrangement of the component gears which minimizes the effects of centrifugal force by bringing all of the gears as close as possible to the central vertical axis 18.

As illustrated in FIGS. 2 and 3, in order to dynamically compensate for the very slight unbalance attributed to the fluid flowing through the tubing loop 16, and the mass of the tubing loop in the vicinity of the tube guide assembly 17, a small washer 29 affixed by means of a screw 30 inserted into a threaded hole 31 is utilized. The mass of the washer 29 is determined using conventional balancing techniques.

What is claimed is:

1. A compensating rotor having, in combination:
(a) a fixed base;
(b) a central vertical axis;
(c) an arm assembly rotatably mounted to the fixed base;
(d) a centrifugal processing container;
(e) a platform rotatably mounted to the arm assembly;
(f) means to secure the centrifugal processing container to the platform;
(g) a stationary feed and collection system;
(h) a flexible tubing loop for effecting the exchange of fluid between the centrifugal processing container and the stationary feed and collection system;
(i) a tube guide mounted on the arm assembly enclosing a segment of the tubing loop; and
(j) drive means including an inherently symmetrical load sharing epicyclic reverted gear train for rotating the platform and arm assembly in the same direction about the central vertical axis and at an angular velocity ratio of 2:1 respectively.

2. A compensating rotor as recited in claim 1, wherein means are provided for dynamically balancing the rotor.

3. A compensating rotor as recited in claim 1, wherein the flexible tubing loop comprises at least one discrete fluid-carrying tube.

4. A compensating rotor as recited in claim 2, wherein the flexible tubing loop comprises at least one discrete fluid-carrying tube.

5. A compensating rotor as recited in claim 2, wherein the dynamic balancing means comprise a washer affixed with a screw inserted into a threaded hole in the arm assembly.

6. A compensating rotor as recited in claim 5, wherein the flexible tubing loop comprises at lease one discrete fluid-carrying tube.

7. A compensating rotor having, in combination:
(a) a fixed base;
(b) a central vertical axis;
(c) an arm assembly rotatably mounted to the fixed base;
(d) a centrifugal processing container;
(e) a platform rotatably mounted to the arm assembly;
(f) means to secure the centrifugal processing container to the platform;
(g) a stationary feed and collection system;
(h) a flexible tubing loop for effecting the exchange of fluid between the centrifugal processing container and the stationary feed and collection system; and
(i) a tube guide mounted on the arm assembly enclosing a segment of the tubing loop;

wherein the improvement comprises:
(1) drive means including an inherently symmetrical load sharing epicyclic reverted gear train for rotating the platform and arm assembly in the same direction about the central vertical axis and at an angular velocity ratio of 2:1 respectively.

8. A compensating rotor as recited in claim 7, wherein means are provided for dynamically balancing the rotor.

9. A compensating rotor as recited in claim 7, wherein the flexible tubing loop comprises at least one discrete fluid carrying tube.

10. A compensating rotor as recited in claim 8, wherein the flexible tubing loop comprises at least one discrete fluid-carrying tube.

11. A compensating rotor as recited in claim 8, wherein the dynamic balancing means comprise a washer affixed with a screw inserted into a threaded hole in the arm assembly.

12. A compensating rotor as recited in claim 11, wherein the flexible tubing loop comprises at least one discrete fluid-carrying tube.

13. A compensating rotor having, in combination:
(a) a fixed base;
(b) a central vertical axis;
(c) an arm assembly rotatably mounted to the fixed base;
(d) a centrifugal processing container;
(e) a platform rotatably mounted to the arm assembly;
(f) means to secure the centrifugal processing container to the platform;
(g) a stationary feed and collection system;

wherein the improvement comprises:
(1) drive means including an inherently symmetrical load sharing epicyclic reverted gear train for rotating the platform and arm assembly in the same direction about the central vertical axis and at an angular velocity ratio of 2:1 respectively;
(2) a flexible tubing loop comprising at least one discrete fluid carrying tube for effecting the exchange of fluid between the centrifugal processing container and the stationary feed and collection system;
(3) a first tube guide freely mounted on the arm assembly enclosing a segment of the tubing loop so that the tube guide freely rotates about its axis by means of the action of the enclosed tubing loop;
(4) a second tube guide freely mounted on the arm assembly being so positioned on the arm assembly so as to provide balance for the first tube guide about the central vertical axis;
(5) a washer affixed with a screw inserted into a threaded hole in the arm assembly being so positioned and of such a mass to compensate for unbalance attributed to fluid flowing through the tubing loop and the mass of the tubing loop in the vicinity of the first tube guide.

* * * * *